US011149403B2

(12) United States Patent
Wada et al.

(10) Patent No.: US 11,149,403 B2
(45) Date of Patent: Oct. 19, 2021

(54) WORK ATTACHMENT AND WORK MACHINE INCLUDING THE SAME

(71) Applicant: KOBELCO CONSTRUCTION MACHINERY CO., LTD., Hiroshima (JP)

(72) Inventors: Ichiro Wada, Hiroshima (JP); Shinji Yamashita, Hiroshima (JP); Yukio Miyano, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/934,072

(22) Filed: Jul. 21, 2020

(65) Prior Publication Data

US 2021/0025125 A1 Jan. 28, 2021

(30) Foreign Application Priority Data

Jul. 26, 2019 (JP) ..... JP2019-137726

(51) Int. Cl.
*E02F 3/38* (2006.01)
*E02F 3/96* (2006.01)

(52) U.S. Cl.
CPC ..... *E02F 3/38* (2013.01); *E02F 3/382* (2013.01); *E02F 3/963* (2013.01); *E02F 3/965* (2013.01)

(58) Field of Classification Search
None
See application file for complete search history.

(56) References Cited

FOREIGN PATENT DOCUMENTS

| | | | | |
|---|---|---|---|---|
| EP | 2 206 837 A2 | | 7/2010 | |
| EP | 2206837 A2 | * | 7/2010 | ..... E02F 3/3636 |
| JP | 58038862 U1 | * | 3/1983 | |
| JP | H02144045 U | * | 12/1990 | |
| JP | 11-193543 A | | 7/1999 | |
| JP | 11193543 A | * | 7/1999 | |
| JP | 2005155304 A | * | 6/2005 | |
| JP | 2009-209549 A | | 9/2009 | |
| JP | 2009209549 A | * | 9/2009 | |

OTHER PUBLICATIONS

Extended European Search Report dated Jan. 15, 2021 in European Patent Application No. 20186629.0, 5 pages.

* cited by examiner

*Primary Examiner* — Gerald McClain
(74) *Attorney, Agent, or Firm* — Oblon, McClelland, Maier & Neustadt, L.L.P.

(57) ABSTRACT

A work attachment is capable of performing work at a high place while restricting the driving force required to lift the work attachment from its fallen posture in a folded state. The work attachment includes a main boom, a first insert boom and a second insert boom to be selectively used, an intermediate boom, an arm, and a distal working device. The intermediate boom has bendable first and second joints. The second insert boom has a fixed shape. The first insert boom is bent to project upward at a middle joint in the fallen posture, thereby making the center of gravity of the work attachment closer to a boom rotation center axis.

8 Claims, 11 Drawing Sheets

WORK ATTACHMENT AND WORK MACHINE INCLUDING THE SAME

TECHNICAL FIELD

The present invention relates to a work attachment constituting a work machine and a work machine including the work attachment.

BACKGROUND ART

A typical work machine for performing work at a high place above the ground, such as demolition work in a building, includes a base machine capable of travelling on the ground and a work attachment attached to the base machine. The work attachment includes a boom attached to the base machine so as to be raiseable and lowerable, an arm attached to the distal end of the boom so as to be capable of rotational movement, and a working device attached to the distal end of the arm.

The work attachment is required to be enough long, when raised, to enable the working device to perform work at a high place. On the other hand, the work attachment is required to be fallen down on the ground in a compact posture. As a work attachment satisfying the above requirements, there is known one having a plurality of booms that are connectable in series with each other.

As the example of such a work attachment, FIG. 11 shows a front device 7 of a hydraulic excavator disclosed in Patent Literature 1 (JP-A-Hei-11-193543). The front device 7 includes a common boom 3, an insert boom 4, an intermediate arm 5, and an arm 6. The common boom 3 has a proximal end attached to a base machine 2 of the hydraulic excavator so as to be raiseable and lowerable, and a distal end opposite thereto. The insert boom 4 has a proximal end detachably connected to the distal end of the common boom 3, and a distal end opposite thereto. The intermediate arm 5 has a boom-side end connected to the distal end of the insert boom 4 so as to be capable of rotational movement, and an arm-side end opposite thereto. The arm 6 has a proximal end connected to the arm-side end of the intermediate arm 5 so as to be capable of rotational movement, and a distal end opposite thereto. A cutter 8, which is a distal working device for cutting a target object, is connected to the distal end of the arm 6 so as to be capable of rotational movement.

The front device 7 further includes a plurality of hydraulic cylinders for changing the posture of the front device 7, namely, a boom cylinder C3, an intermediate arm cylinder C5, an arm cylinder C6, and a working tool cylinder C8. The boom cylinder C3 is interposed between the base machine 2 and the common boom 3, being expanded and contracted to raise and lower the common boom 3 relatively to the base machine 2. The intermediate arm cylinder C5 is interposed between the common boom 3 and the intermediate arm 5, being expanded and contracted to cause the intermediate arm 5 to make rotational movement relative to the common boom 3. The arm cylinder C6 is interposed between the intermediate arm 5 and the arm 6, being expanded and contracted to cause the arm 6 to make rotational movement relative to the intermediate arm 5. The working tool cylinder C8 is interposed between the arm 6 and the cutter 8, being expanded and contracted to cause the cutter 8 to make rotational movement relative to the arm 6.

The intermediate arm 5 is shorter than either of the insert boom 4 and the arm 6, thereby allowing the entire front device 7 to take a fallen posture in a folded state as shown in FIG. 11. In the fallen posture, the common boom 3 and the insert boom 4 extend horizontally, the intermediate arm 5 extends vertically at the foremost position of the front device 7, and the arm 6 extends horizontally under the insert boom 4 while touching the ground. In short, the fallen posture is a posture where the entire front device 7 is fallen down on a ground surface G while being folded back by approximately 180 degrees with the intermediate arm 5 as the turning section.

Such a work attachment as the front device 7 capable of taking the fallen posture in the folded state has a problem of the difficulty of improvement of the workability of the work attachment at a high place, because of a limit to the driving force to be applied to the work attachment to raise it rotationally from the fallen posture. For example, the maximum height the cutter 8 of the front device 7 can reach in the raised posture might be increased by increasing respective lengths of the insert boom 4 and the arm 6; however, the increase in the lengths would bring the center of gravity of the entire front device 7 in the fallen posture as shown in FIG. 11 away from the base machine 2, which increases the moment required to move the front device 7 rotationally in a rising direction (upward) while keeping its fallen posture. On the other hand, there is a limit on the driving force (the thrust of the boom cylinder C3 in FIG. 7) for generating the moment. These result in a significant restriction on lengthening the insert boom 4 and the arm 6 for improving the workability at a high place.

SUMMARY OF INVENTION

The present invention has been made to solve the above-mentioned problem, having an object to provide a work attachment constituting a work machine, the word attachment being capable of taking a fallen posture in a folded state and capable of performing work at a high place without significantly increasing the driving force required for the rotational movement in the rising direction from its fallen posture, and a work machine including the work attachment.

Provided is a work attachment to be attached to a base machine of a work machine so as to be raiseable and lowerable, being capable of taking a fallen posture of being fallen down on a ground surface forward of the base machine, the work attachment comprising: a main boom having a proximal end to be connected to the base machine so as to be capable of rotational movement about a predetermined boom rotation center axis to be raised and lowered and a distal end opposite to the proximal end; a first insert boom having a proximal end connectable to the distal end of the main boom detachably and a distal end opposite to the proximal end of the first insert boom; a second insert boom having a proximal end connectable to the distal end of the main boom detachably and a distal end opposite to the proximal end of the second insert boom; an intermediate boom having a proximal end connectable detachably to either of the distal end of the first insert boom and the distal end of the second insert boom and a distal end opposite to the proximal end of the intermediate boom; an arm having a proximal end connected to the distal end of the intermediate boom so as to be capable of rotational movement relative to the intermediate boom about an axis parallel to the boom rotation center axis and a distal end opposite to the proximal end of the arm; and a distal working device connected to the distal end of the arm and configured to perform a specific working motion. Each of the first insert boom and the second insert boom is capable of being selectively interposed between the distal end of the main boom and the proximal end of the intermediate boom to be used as a selected insert boom. The intermediate boom has a first joint and a second joint located closer to the distal end thereof than the first joint, being bendable about an axis parallel to the boom rotation center axis so as to project outward at each of the first joint and the second joint. The second insert boom has a fixed shape extending in a specific direction of interconnecting the distal end of the main boom and the proximal end of the intermediate boom, and has a length that allows the entire work attachment to take a second fallen posture when being selected as the selected insert boom. The second fallen posture is a posture satisfying the following conditions: the main boom and the second insert boom extend horizontally; the intermediate boom is bent to project outward at each of the first joint and the second joint at a foremost position of the work attachment to thereby direct both the proximal end and the distal end of the intermediate boom backward; and the arm extends horizontally under the main boom and the second insert boom while touching the ground surface. The first insert boom has a middle joint located between the proximal end and the distal end thereof, being bendable about an axis parallel to the boom rotation center axis so as to project outward at the middle joint. The working attachment that includes the first insert boom selected as the selected insert boom has a total weight greater than a total weight of the working attachment that includes the second insert boom selected as the selected insert boom. The first insert boom has a greater total length with the middle joint extended linearly than a total length of the second insert boom, and has a shape to allow the entire work attachment to take a first fallen posture when the first insert boom is bent to project outward at the middle joint. The first fallen posture is a posture satisfying the following conditions: the main boom is inclined upward from the proximal end toward the distal end thereof; the first insert boom is bent to project upward at the middle joint so that a proximal portion of the first insert boom is inclined upward from the proximal end toward the middle joint and a distal portion of the first insert boom is inclined downward from the middle joint toward the proximal end of the intermediate boom, the proximal portion being a portion located on a proximal-end side of the middle joint, the distal portion being a portion located on a distal-end side of the middle joint; the intermediate boom is bent so as to project outward at each of the first joint and the second joint at the foremost position of the work attachment to direct both the proximal end and the distal end of the intermediate boom backward; and the arm extends horizontally under the main boom and the first insert boom while touching the ground surface, the bend of the first insert boom at the middle joint shifting a position of the distal working device horizontally toward the boom rotation center axis by a distance corresponding to the bend.

DESCRIPTION OF EMBODIMENTS

Figure 1:
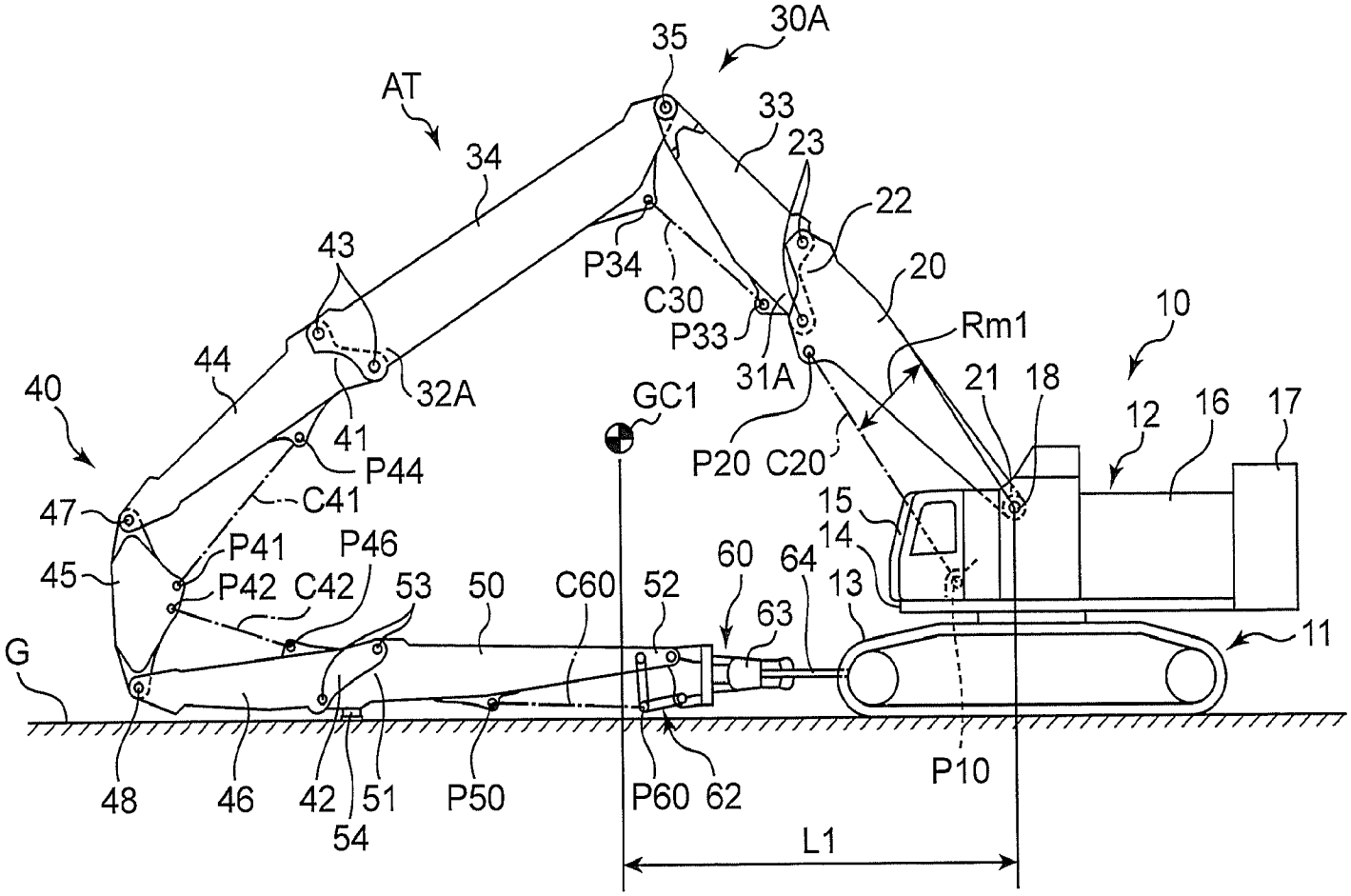
FIG. 1 is a side view of a work attachment according to an embodiment of the present invention, the work attachment being in a first use mode with use of a first insert boom and in a first fallen posture.

A preferred embodiment of the present invention will be described with reference to FIGS. 1 to 10.

FIGS. 1 to 10 show a work attachment AT according to the present embodiment and a work machine including the work attachment AT. In the present embodiment, the work machine is illustrated in the form of a demolition machine, and the work attachment AT is configured to perform demolition work. However, the work machine to which the present invention is applied is not limited to the demolition machine. The present invention can be widely applied to various types of work attachments that are required to perform work at a high place and work machines including such a work attachment. For example, the work attachment according to the present invention may include, as a distal working device, either a breaker or a raising magnet.

The work machine according to the present embodiment includes the work attachment AT and a base machine 10. The base machine 10 includes a lower travelling body 11 and an upper slewing body 12. The lower travelling body 11 includes a not-graphically-shown lower frame and a pair of crawler tracks 13 disposed at the right and left sides of the lower frame, being capable of travelling on a ground surface G with the crawler tracks 13 driven. The upper slewing body 12 includes a slewing frame 14 and a plurality of slewing elements mounted on the slewing frame 14. The slewing frame 14 is mounted on the lower frame of the lower travelling body 11 so as to be slewable about a vertical axis. The plurality of slewing elements include a cab 15, a machine room 16, and a counterweight 17.

Figure 2:
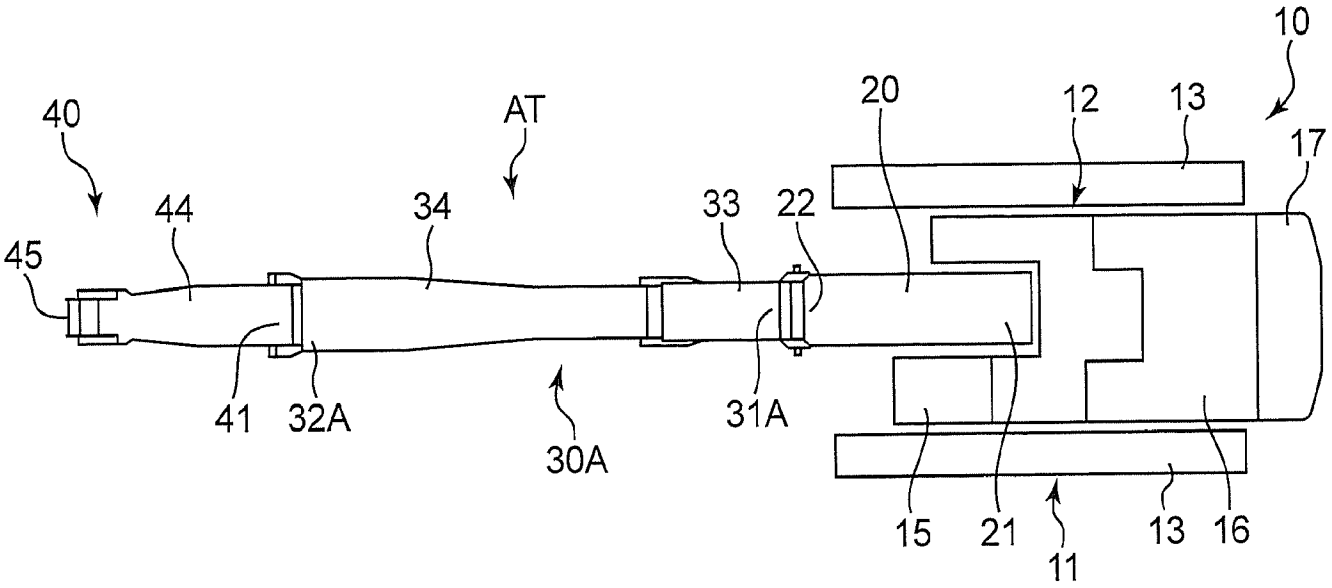
FIG. 2 is a top plan view of FIG. 1.
Figure 3:
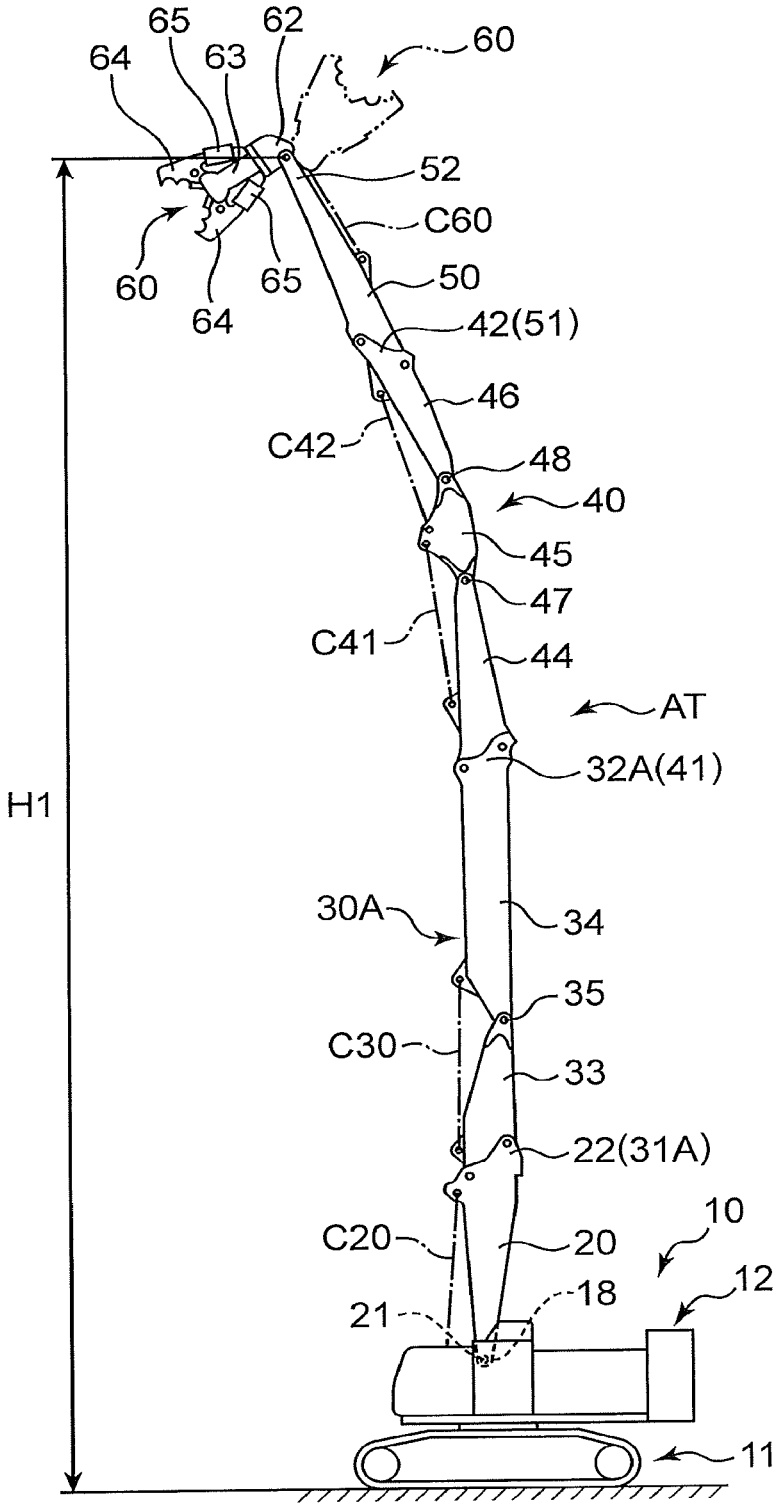
FIG. 3 is a side view of a state where the work attachment in the first use mode is raised and extended.
Figure 4:
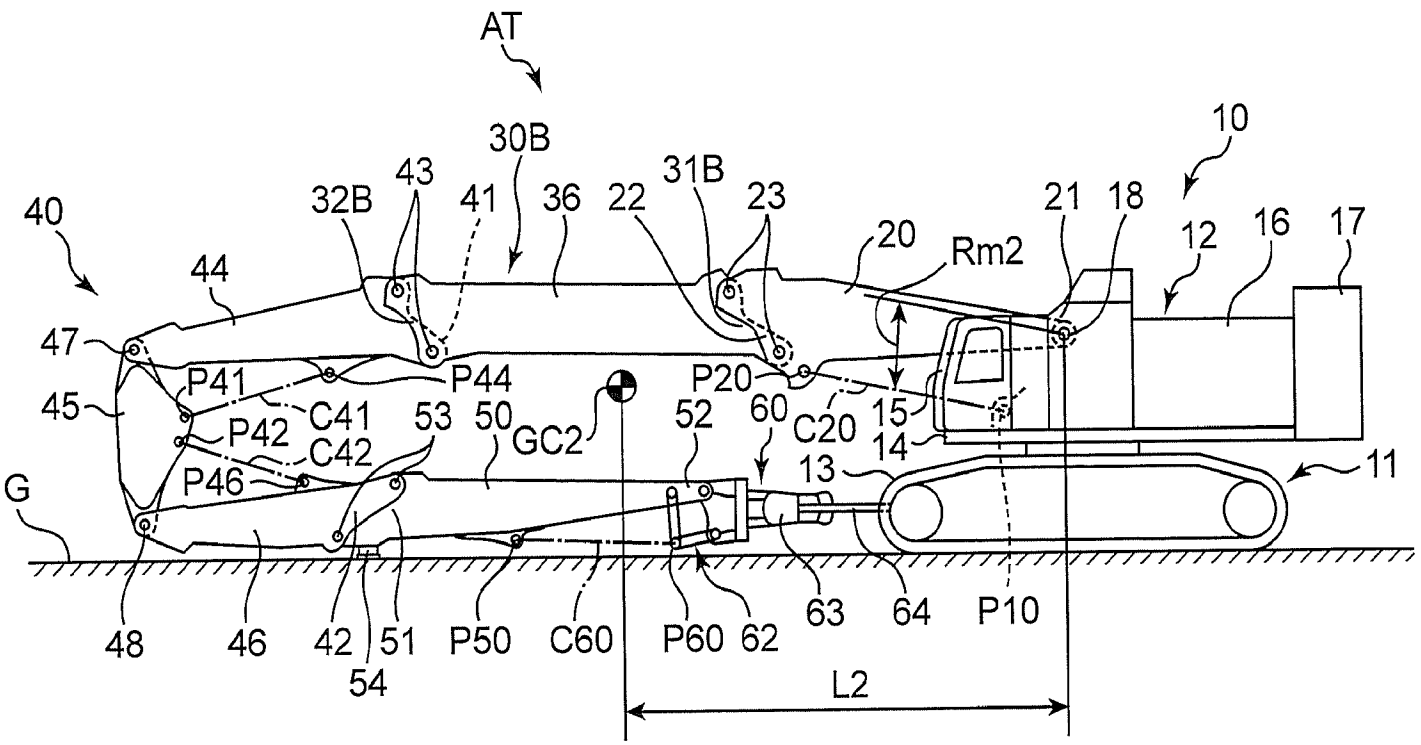
FIG. 4 is a side view of the work attachment in a second use mode with use of a second insert boom and in a second fallen posture.
Figure 5:
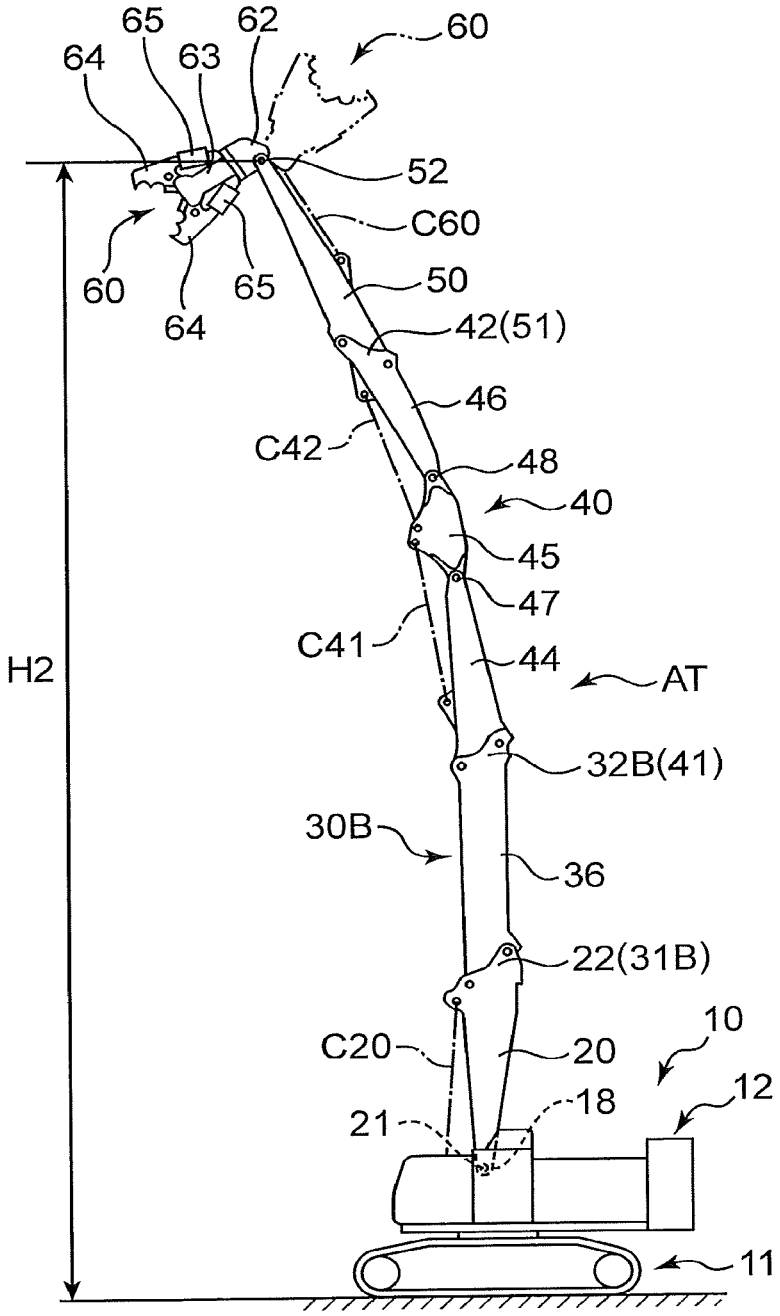
FIG. 5 is a side view of a state where the work attachment in the second use mode is raised and extended.

The work attachment AT includes a main boom 20, a first insert boom 30A shown in FIGS. 1 to 3, a second insert boom 30B shown in FIGS. 4 and 5, an intermediate boom 40, an arm 50, and a distal working device 60. The main boom 20, a selected insert boom that is selected for use from the first insert boom 30A and the second insert boom 30B, the arm 50, and the distal working device 60 are arranged in series in this order and connected with each other, thereby forming the work attachment AT.

The main boom 20 has a proximal end 21 and a distal end 22 opposite to the proximal end 21, having a shape extending from the proximal end 21 to the distal end 22. The proximal end 21 is connected to the base machine 10 so as to be capable of rotational movement about a boom rotation center axis extending in a lateral direction parallel to the ground surface G. Specifically, the proximal end 21 is connected to an appropriate portion of the upper slewing body 12 through a boom foot pin 18 centered on the boom rotation center axis, and makes rotational movement about the boom foot pin 18 (i.e. about the boom rotation center axis). The main boom 20 is thereby allowed to make rotational movement relative to the base machine 10 in a rising and falling direction, i.e., a vertical direction.

The first insert boom 30A has a proximal end 31A and a distal end 32A opposite to the proximal end 31A, the proximal end 31A being connectable to the distal end 22 of the main boom 20 detachably through a pair of pins 23, 23 disposed in parallel to the boom rotation center axis. Similarly, the second insert boom 30B has a proximal end 31B and a distal end 32B opposite to the proximal end 31B, the proximal end 31B being connectable to the distal end 22 of the main boom 20 detachably through the pins 33, 33. Thus, each of the proximal ends 31A and 31B of respective first and second insert booms 30A and 30B is capable of being selectively connected to the distal end 22 of the main boom 20.

Regarding specific shapes and structures of the first and second insert booms 30A and 30B, below will be described in detail.

The intermediate boom 40 has a proximal end 41 and a distal end 42 opposite to the proximal end 41. The proximal end 41 is connectable detachably to either of the distal end 32A of the first insert boom 30A and the distal end 32B of the second insert boom 30B through a pair of pins 43, 43. In other words, each of the distal ends 32A and 32B of respective first and second insert booms 30A and 30B is capable of being selectively connected to the proximal end 41 of the intermediate boom 40. Thus, each of the first and second insert booms 30A and 30B is capable of being selectively interposed between the distal end 22 of the main boom 20 and the proximal end 41 of the intermediate boom 41.

The intermediate boom 40 has a first joint and a second joint located closer to the distal end 42 than the first joint, being bendable about an axis parallel to the boom rotation center axis so as to project outward at each of the first joint and the second joint. Specifically, the intermediate boom 40 includes a proximal member 44, an intermediate member 45, and a distal member 46 that are arranged in series in this order from the proximal end 41 of the intermediate boom 40. The proximal member 44 has a proximal end and a distal end opposite thereto, the proximal end serving as the proximal end 41 of the entire intermediate boom 40. The intermediate member 45 has a proximal end and a distal end opposite thereto, the proximal end being connected to the distal end of the proximal member 44 through a pin 47 so as to be capable of rotational movement relative to the proximal member 44 about an axis parallel to the boom rotation center axis. The pin 47 thus forms the first joint. The distal member 46 has a proximal end and a distal end opposite thereto, the proximal end of the distal member 46 being connected to the distal end of the intermediate member 45 through a pin 48 so as to be capable of rotational movement relative to the intermediate member 45 about an axis parallel to the boom rotation center axis. The pin 48 thus forms the second joint. The distal end of the distal member 46 serves as the distal end 42 of the entire intermediate boom 40. The intermediate member 45 is shorter than either of the proximal member 44 and the distal member 46.

The arm 50 has a proximal end 51 and a distal end 52 opposite to the proximal end 51, having a shape extending linearly from the proximal end 51 to the distal end 52. The proximal end 51 is connectable to the distal end 42 of the intermediate boom 40 detachably through a pair of pins 53, 53.

The distal working device 60 is connected to the distal end 52 of the arm 50 so as to be capable of rotational movement relative to the arm 50. In the present embodiment, a link mechanism 62 is interposed between the distal working device 60 and the distal end 52, interconnecting the distal working device 60 and the distal end 52 so as to allow the distal working device 60 to make rotational movement relative to the distal end 52 about an axis parallel to the boom rotation center axis.

The distal working device 60 according to the present embodiment is a crusher, which includes a crusher body 63, a pair of crusher blades 64, 64, and a pair of crusher cylinders 65, 65. The crusher body 63 is connected to the link mechanism 62 while supporting the pair of crusher blades 64, 64 so as to allow the crusher blades 64, 64 to be opened and closed, that is, to make rotational movement about respective rotational axes parallel to each other. The pair of crusher cylinders 65, 65 are interposed between the pair of crusher blades 64, 64 and the crusher body 63, respectively, and expanded and contracted to actuate the pair of crusher blades 64, 64 in opening and closing directions.

The second insert boom 30B is formed of a single boom member 36 having a fixed shape. The shape of the boom member 36 extends from the proximal end 31B to the distal end 32B in a specific direction of interconnecting the distal end 22 of the main boom 20 and the proximal end 41 of the intermediate boom 40. More specifically, the second insert boom 30B according to the present embodiment has a shape extending linearly in alignment with the main boom 20 and the proximal member 44 of the intermediate boom 40 when being connected to each of the main boom 20 and the intermediate boom 40.

The second insert boom 30B has a length that allows the entire work attachment AT to take a second fallen posture as shown in FIG. 4 when the second insert boom 30B is selected as the selected insert boom, that is, when the second insert boom 30B is interposed between the main boom 20 and the intermediate boom 40. The second fallen posture is a posture that satisfies the following conditions (B1), (B2) and (B3).

(B1) The main boom 20 and the second insert boom 30B extend horizontally. The expression "extend horizontally" is intended not to limit to the mode where respective central axes of the main boom 20 and the second insert boom 30B are exactly horizontal but to encompass also a mode where the respective central axes are slightly inclined to the horizon.

(B2) The intermediate boom 40 is bent to project outward at the first joint and the second joint (the pins 47 and 48 in the present embodiment) at the foremost position (the leftmost position in FIGS. 1 and 2) of the work attachment AT to thereby direct both the proximal end 41 and the distal end 42 of the intermediate boom 40 backward. More specifically, the proximal member 44 and the distal member 46 extend from upper and lower ends of the intermediate member 45 toward the base machine 10, the intermediate member 45 extending vertically. Here, the expression "to direct both the proximal end 41 and the distal end 42 rearward" is intended not to limit to the mode where both the ends 41, 42 are directed exactly horizontally but to encompass also a mode where they are directed slightly inclinedly to the horizon.

(B3) The arm 50 extends horizontally under the main boom 20 and the second insert boom 30B while touching the ground. In the present embodiment, a spacer 54 touches the ground surface G, being projected on the back surface (a lower surface in the second fallen posture shown in FIG. 4) of the arm 50. The expression "extends horizontally" is intended not to limit to the mode where the central axis of the arm 50 is exactly horizontal but to encompass also a mode where the central axis is slightly inclined to the horizon.

On the other hand, the first insert boom 30A has a middle joint at a middle position between the proximal end 31A and the distal end 32A to have a structure bendable about an axis parallel to the boom rotation center axis to project outward at the middle joint. Specifically, the first insert boom 30A includes a proximal member 33 connectable to the distal end 22 of the main boom 20 and a distal member 34 connectable to the proximal end 41 of the intermediate boom 40. The proximal member 33 has a proximal end and a distal end opposite to the proximal end, the proximal end serving as the proximal end 31A of the entire first insert boom 30A. The distal member 34 has a proximal end and a distal end opposite thereto, the proximal end of the distal member 34 being connected to the distal end of the proximal member 33 through a pin 35 so as to be capable of rotational movement relative to the proximal member 33 about an axis parallel to the boom rotation center axis. The pin 35 thus forms the middle joint. The distal end of the distal member 34 serves as the distal end 32A of the entire first insert boom 30A. In the present embodiment, each of the proximal member 33 and the distal member 34 has a shape extending linearly, wherein the distal member 34 is longer than the proximal member 33.

The first insert boom 30A has a greater total length than the total length of the second insert boom 30B (that is, the total length of the boom member 36 in the present embodiment) when extended linearly at the middle joint, i.e., when the proximal member 33 and the distal member 34 form therebetween an opening angle of approximately 180 degrees as shown in FIG. 3. On the other hand, the first insert boom 30A has a shape that allows the entire work attachment AT to take a first fallen posture as shown in FIG. 1 when being bent to project outward at the middle joint, i.e., in the present embodiment, when the proximal member 33 and the distal member 34 form an opening angle of approximately 90 degrees on the inner side thereof as shown in FIG. 1. The first fallen posture is a posture that satisfies the following conditions (A1), (A2), and (A3).

(A1) The first insert boom 30A is bent to project upward at the middle joint. The details are the following: the main boom 20 is inclined upward from the proximal end 21 toward the distal end 22 thereof; the proximal member 33 which is a portion located on the proximal-end side of the middle joint in the first insert boom 30A is inclined upward from the proximal end 31A toward the pin 35 that forms the middle joint; and the distal member 34 which is a portion on the distal-end side of the middle joint in the first insert boom 30A is inclined downward from the pin 35 that forms the middle joint toward the proximal end 41 of the intermediate boom 40.

Respective specific inclination angles of the proximal member 33 and the distal member 34 are not particularly limited. Therefore, the open angle formed by these members 33 and 34 is also not limited. In the present embodiment, the proximal member 33 extends inclinedly upward from the boom foot pin 18 and linearly in alignment with the main boom 20, and the distal member 34 extends inclinedly downward from the pin 35 and linearly in alignment with the proximal member 44 of the intermediate boom 40.

(A2) In the same manner as in the above-described second fallen posture, the intermediate boom 40 is bent to project outward at the first joint and the second joint (the pins 47 and 48 in the present embodiment) at the foremost position (the leftmost position in FIGS. 1 and 2) of the work attachment AT to thereby direct the proximal end 41 and the distal end 42 of the intermediate boom 40 backward. More specifically, the proximal member 44 and the distal member 46 extending from the upper and lower ends of the intermediate member 45 of the intermediate boom 40, respectively, toward the base machine 10, the intermediate member 45 extending vertically. However, in the first fallen posture, the proximal member 44 is inclined upward and rearward (i.e. toward the base machine 10) from the pin 47 linearly in alignment with the distal member 34 of the first insert boom 30A. In summary, in the present embodiment, the main boom 20, the first insert boom 30A, and the proximal member 44 of the intermediate boom 40 form a reversed V-shape that is bent to project upward at the pin 35 as the apex, the pin 35 forming the middle joint.

(A3) In the same manner as in the above-described second fallen posture, the arm 50 extends horizontally under the main boom 20 and the second insert boom 30B while touching the ground. In the present embodiment, touching the ground surface G is the spacer 54 projected on the back surface of the arm 50. Also the expression "extends horizontally" is intended not to limit to the mode where the central axis of the arm 50 is exactly horizontal but intended to encompass also a mode where the central axis is slightly inclined to the horizon.

The bend of the first insert boom 30A to project upward in the first fallen posture allows the distal end of the distal working device 60 to be closer to the boom foot pin 18 horizontally by a distance corresponding to the bend. In the present embodiment, the first insert boom 30A is bendable enough to allow the distal end of the distal working device 60 to reach a front end of the base machine 10 (respective front ends of the right and left crawlers 13 in the present embodiment) or a position rearward thereof (a position rearward of the respective front ends of the right and left crawlers 13 with no interference of the distal end of the distal working device 60 with the lower frame between the right and left crawlers 13 in the example shown in FIG. 1).

The work attachment AT further includes a plurality of hydraulic cylinders for changing the posture of the work attachment AT. Each of the hydraulic cylinders is expanded and contracted by hydraulic oil supplied from the base machine 10 to thereby change each angle formed by two components included in the work attachment AT, thereby changing the posture of the entire work attachment AT.

Specifically, the plurality of hydraulic cylinders include a main boom cylinder C20, an insert boom cylinder C30, a first intermediate boom cylinder C41, a second intermediate boom cylinder C42, and a distal working device cylinder C60. These cylinders C20, C30, C41, C42, and C60 are schematically indicated by dash-dot lines in the drawings.

The main boom cylinder C20 is interposed between the base machine 10 and the main boom 20 so as to raise and lower the main boom 20 relatively to the base machine 10 by the expansion and contraction thereof. Specifically, the main boom cylinder C20 has a machine-side end and a boom-side end opposite to the machine-side end. The machine-side end is connected to an appropriate portion of the base machine 10 (a portion of the base machine 10 located forward and downward of the boom foot pin 18 in the present embodiment) through a cylinder pin P10 so as to be capable of rotational movement about an axis parallel to the boom rotation center axis, and the boom-side end is connected to an appropriate portion of the main boom 20 (a portion of the back surface of the distal end 22 in the present embodiment) through a cylinder pin P20 so as to be capable of rotational movement about an axis parallel to the boom rotation center axis. The main boom cylinder C20 is, thus, disposed so as to have a rising angle relative to a horizontal plane, the rising angle being increased with increase in the rising angle of the main boom 20 to the horizontal plane. Besides, the rising angle of the main boom 20 to the horizontal plane is increased with the expansion of the main boom cylinder 20 and decreased with the contraction of the main boom cylinder C20.

The first intermediate boom cylinder C41 is interposed between the proximal member 44 and the intermediate member 45 of the intermediate boom 40 so as to change the angle formed by the proximal member 44 and the intermediate member 45, i.e., so as to so as to cause the proximal member 44 and the intermediate member 45 to make rotational movement relative to each other, by the expansion and contraction of the first intermediate boom cylinder C41. Specifically, the first intermediate boom cylinder C41 has a proximal end and a first intermediate end. The proximal end is connected to an appropriate portion of the proximal member 44 (in the present embodiment, a back-surface-side portion near the proximal end 41) through a cylinder pin P44 so as to be capable of rotational movement about an axis parallel to the boom rotation center axis. The first intermediate end is connected to an appropriate portion of the intermediate member 45 (in the present embodiment, an inner end of the intermediate member 45) through a cylinder pin P41 so as to be capable of rotational movement about an axis parallel to the boom rotation center axis. Therefore, the angle formed by the proximal member 44 and the intermediate member 45 is increased with the expansion of the first intermediate boom cylinder C41 and decreased with the contraction of the first intermediate boom cylinder C41.

The second intermediate boom cylinder C42 is interposed between the intermediate member 45 and the distal member 46 of the intermediate boom 40 so as to change the angle formed by the intermediate member 45 and the distal member 46, i.e., so as to cause the intermediate member 45 and the distal member 46 to make rotational movement relative to each other, by the expansion and contraction thereof. Specifically, the second intermediate boom cylinder C42 has a second intermediate end and a distal end. The second intermediate end is connected to an appropriate portion of the intermediate member 45 (in the present embodiment, the inner end of the intermediate member 45) through a cylinder pin P42 so as to be capable of rotational movement about an axis parallel to the boom rotation center axis. The distal end is connected to an appropriate portion of the distal member 46 (in the present embodiment, a back-surface-side portion near the distal end 42) through a cylinder pin P46 so as to be capable of rotational movement about an axis parallel to the boom rotation center axis. Therefore, the angle formed by the intermediate member 45 and the distal member 46 is increased with the expansion of the second intermediate boom cylinder C42 and decreased with the contraction of the second intermediate boom cylinder C42.

The distal working device cylinder C60 is interposed between the arm 50 and the link mechanism 62 so as to cause the distal working device 60 to make rotational movement relative to the arm 50 about an axis parallel to the boom rotation center axis by the expansion and contraction thereof. Specifically, the distal working device cylinder C60 has an arm-side end and a device-side end opposite to the arm-side end. The arm-side end is connected to an appropriate portion of the arm 50 (in the present embodiment, a portion at the back-surface side) through a cylinder pin 50 so as to be capable of rotational movement about an axis parallel to the boom rotation center axis. The device-side end is connected to the link mechanism 62 through a cylinder pin P60 so as to be capable of rotational movement about an axis parallel to the boom rotation center axis.

The insert boom cylinder C30 is attached to the first insert boom 30A so as to extend and bend the first inset boom 30A, i.e. so as to change the angle formed by the proximal member 33 and the distal member 34, by the expansion and contraction thereof. Specifically, the insert boom cylinder C30 has a proximal end and a distal end opposite to the proximal end. The proximal end is connected to an appropriate portion of the proximal member 33 that is a portion located on the proximal-end side of the middle joint, that is, located between the middle joint and the proximal end of the first insert boom 30 (in the present embodiment, a back-surface portion of the proximal end 31A), through a cylinder pin P33 so as to be capable of rotational movement about an axis parallel to the boom rotation center axis. The distal end is connected to an appropriate portion of the distal member 34 that is a portion located on the distal-end side of the middle joint, that is, located between the middle joint and the distal end of the first insert boom 30 (in the present embodiment, a back-surface portion of the proximal end of the proximal end 31A), through a cylinder pin P34 so as to be capable of rotational movement about an axis parallel to the boom rotation center axis. Therefore, the angle formed by the proximal member 33 and the distal member 34 is increased (that is, the expansion of the first insert boom 30A proceeds) with the expansion of the insert boom cylinder C30 and decreased (i.e. the bend of the first insert boom 30A proceeds) with the contraction of the insert boom cylinder C30.

Such respective connections of the opposite ends of the insert boom cylinder C30 to the first insert boom 30A allow the operation of attaching or detaching the insert boom cylinder C30 to or from the other component to be eliminated for attaching or detaching the first insert boom 30A to or from the main boom 20 and the intermediate boom 40, differently from a mode where one end of the insert boom cylinder C30 is connected to a component other than the first insert boom 30A (e.g., the main boom 20 or the intermediate boom 40).

The work attachment AT according to the present embodiment further includes an optional boom 70 shown in FIGS. 7 to 10. The optional boom 70 is capable of being additionally interposed between the distal end 22 of the main boom 20 and the proximal end of the selected insert boom (the proximal end 31A of the first insert boom 30A or the proximal end 31B of the second insert boom 30B).

Specifically, the optional boom 70 has a proximal end 71 and a distal end 72 opposite to the proximal end 71, having a shape extending from the proximal end 71 to the distal end 72. The proximal end 71 is connectable to the distal end 22 of the main boom 20 detachably through the pair of pins 23, 23, in place of the proximal end 31A of the first insert boom 30A or the proximal end 31B of the second insert boom 30B. The distal end 72 is connectable detachably through the pair of pins 24, 24 to either of the proximal end 31A of the first insert boom 30A and the proximal end 31B of the second insert boom 30B, in place of the distal end 22 of the main boom 20.

In either case of use of the first insert boom 30A and use of the second insert boom 30B as the selected insert boom, additional interposition of the optional boom 70 between the proximal end of the selected insert boom and the distal end 22 of the main boom 20 enables the maximum height of the work by the distal working device 60 to be increased. The optional boom 70, however, is not an essential component of the present invention but a component allowed to be appropriately omitted.

The above-described configurations allows the work attachment AT according to the present embodiment to have at least the following four use modes.

(1) First Use Mode

As shown in FIGS. 1 to 3, the first use mode is a mode where the first insert boom 30A is selected as the selected insert boom and only the first insert boom 30A is interposed between the distal end 22 of the main boom 20 and the proximal end 41 of the intermediate boom 40. In the first use mode, raising the main boom 20 and extending the first insert boom 30A as shown in FIG. 3 enables a first maximum height H1 to be achieved as the maximum working height at which work can be performed by the distal working device 60.

(2) Second Use Mode

As shown in FIGS. 4 and 5, the second use mode is a mode where the second insert boom 30B is selected as the selected insert boom and only the second insert boom 30B is interposed between the distal end 22 of the main boom 20 and the proximal end 41 of the intermediate boom 40. In the second use mode, raising the main boom 20 as shown in FIG. 5 enables a second maximum height H2 to be achieved as the maximum working height. Since the total length of the first insert boom 30A in the extended state is greater than the total length of the second insert boom 30B, the second maximum height H2 is less than the first maximum height H1 (H1>H2).

(3) Third Use Mode

Figure 7:
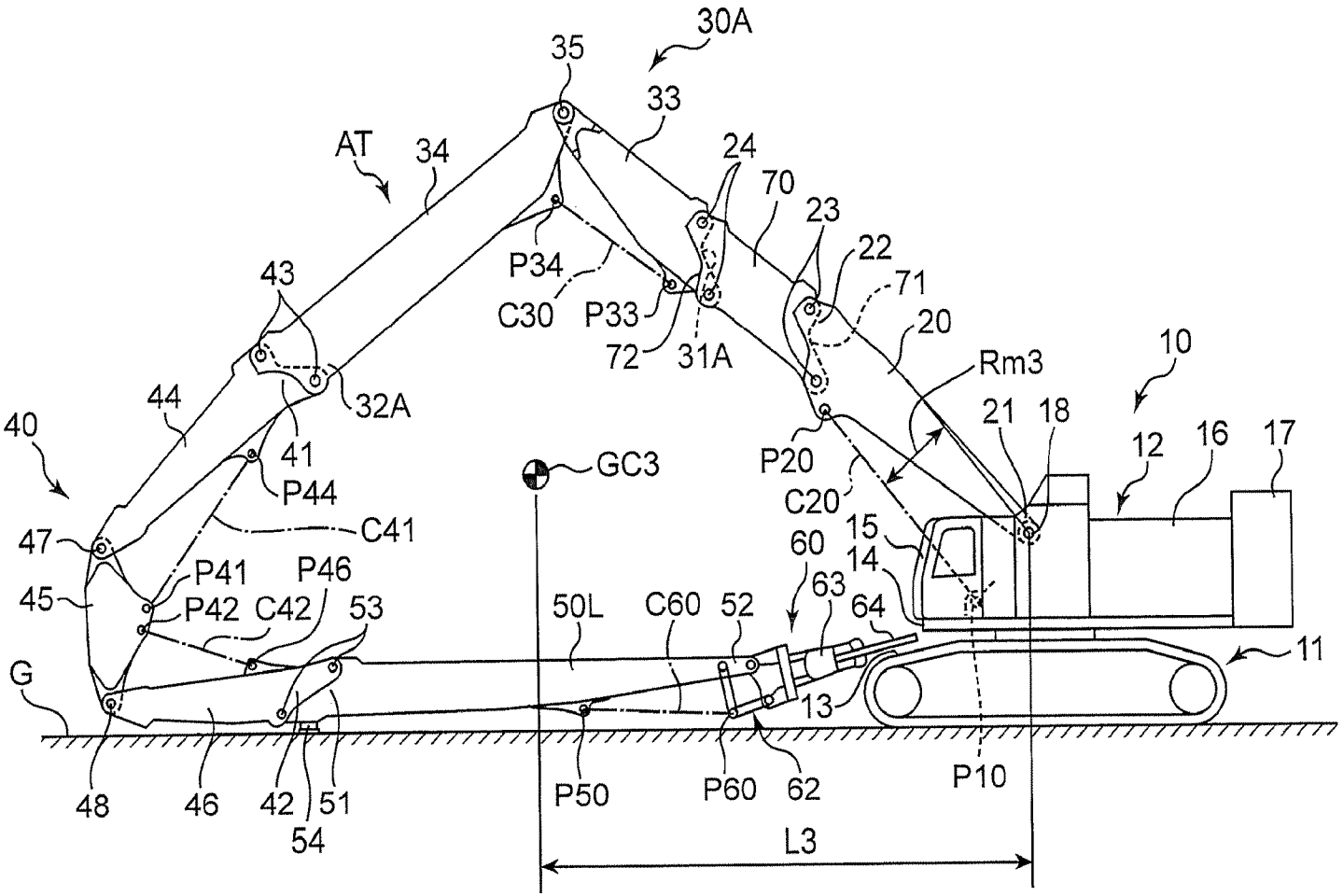
FIG. 7 is a side view of the work attachment in a third use mode with use of the first insert boom and an optional boom and in the first fallen posture.
Figure 8:
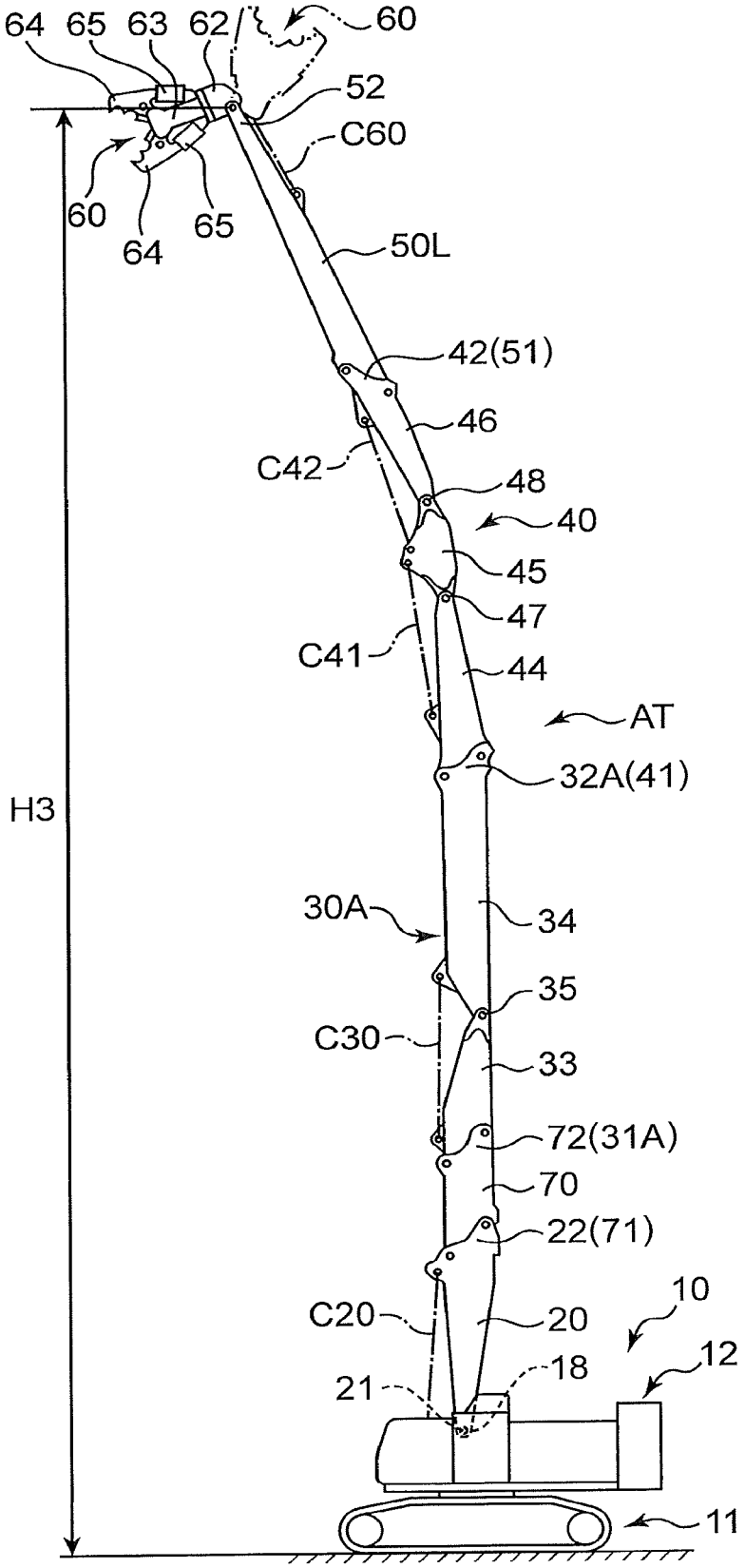
FIG. 8 is a side view of a state where the work attachment in the third use mode is raised and extended.

As shown in FIGS. 7 and 8, the third use mode is a mode where the first insert boom 30A is selected as the selected insert boom and the optional boom 70 is additionally disposed between the proximal end 31A of the first insert boom 30A and the distal end 22 of the main boom 22. The addition of the optional boom 70, which increases the length in the fallen posture from the boom foot pin 18 to the pin 47 located on the proximal end side of the intermediate boom 40, allows a long arm 50L with a greater total length than that of the arm 50 to be used, in place of the arm 50, to serve as the arm that is located under them. In the third use mode, raising the main boom 20 and extending the first insert boom 30A as shown in FIG. 8 enables a third maximum height H3 to be achieved as the maximum working height. The third maximum height H3 is greater than the first maximum height H1 (H3>H1>H2) by the length of the added optional boom 70 and the difference between respective lengths of the long arm SOL and the arm 50.

(4) Fourth Use Mode

Figure 9:
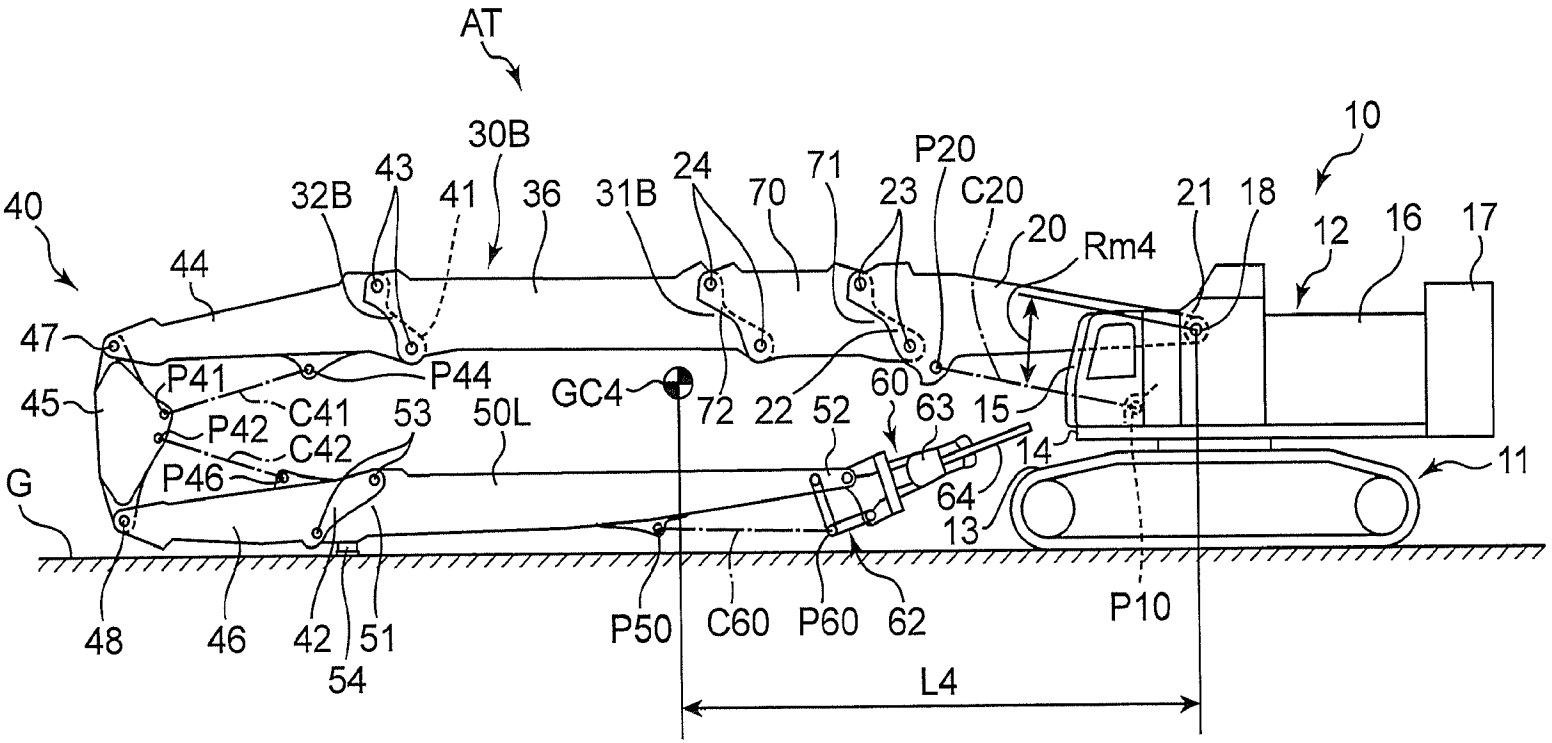
FIG. 9 is a side view of the work attachment in a fourth use mode with use of the second insert boom and the optional boom and in the second fallen posture.
Figure 10:
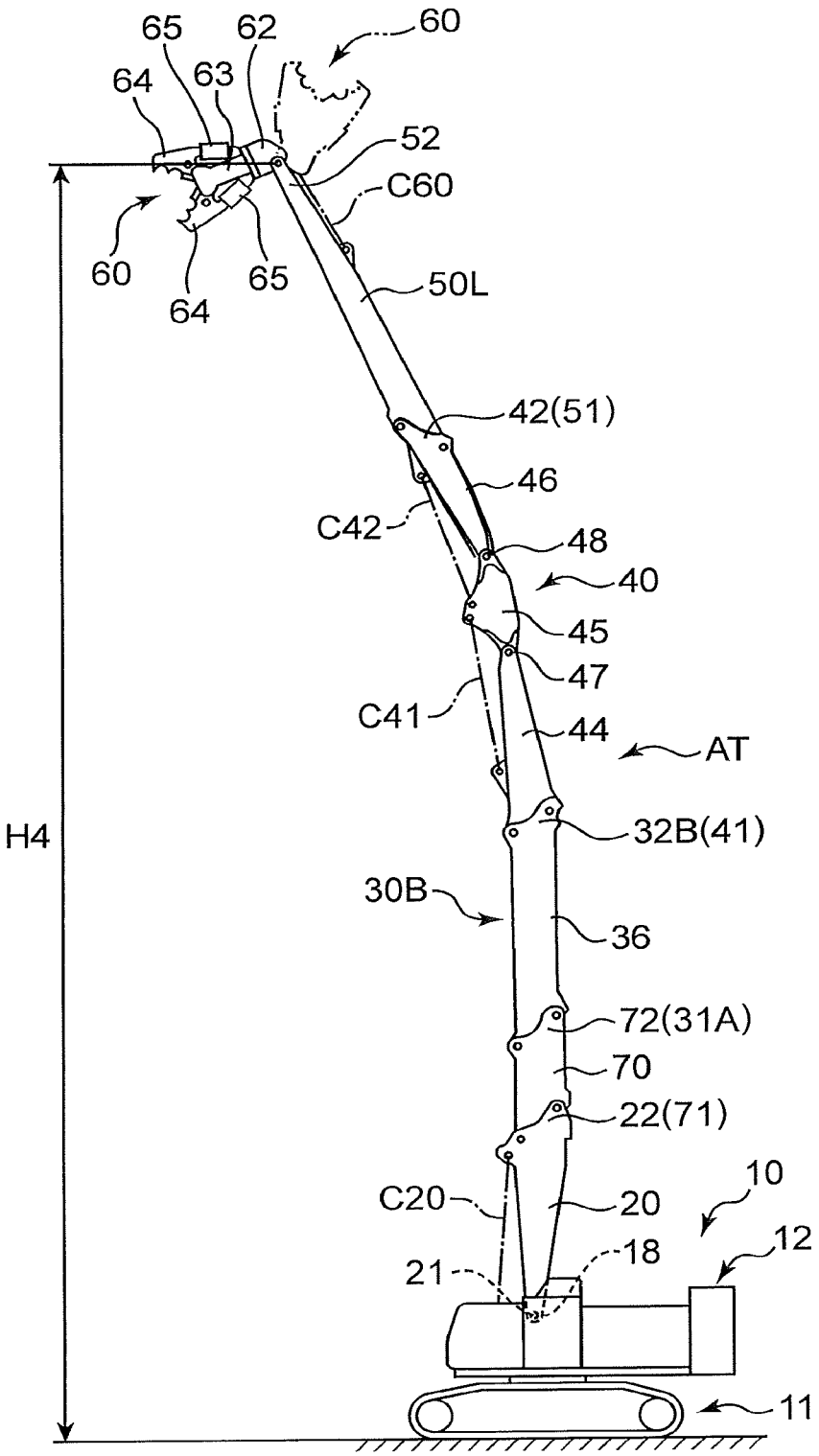
FIG. 10 is a side view of a state where the work attachment in the fourth use mode is raised and extended.
Figure 11:
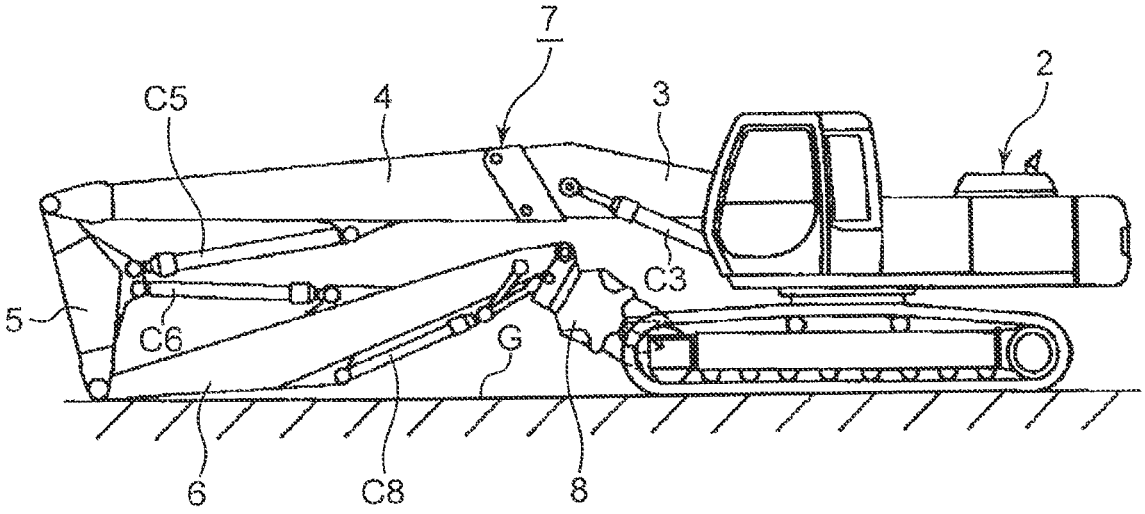
FIG. 11 Conventional Art
FIG. 11 is a side view of a conventional work machine in which a work attachment is in a fallen posture.

As shown in FIGS. 9 and 10, the fourth use mode is a mode where the second insert boom 30B is selected as the selected insert boom and the optional boom 70 is additionally disposed between the proximal end 31B of the second insert boom 30B and the distal end 22 of the main boom 22. Similarly to the third use mode, the addition of the optional boom 70 allows the long arm 50L to be used in place of the arm 50. In the fourth use mode, raising the main boom 20 as shown in FIG. 10 enables a fourth maximum height H4 to be achieved as the maximum working height. The fourth maximum height H4 is less than the third maximum height H3 but greater than the second maximum height H2 (H3>H4>H2) because of the length of the added optional boom 70 and the difference between respective lengths of the long arm 50L and the length of the arm 50. While the relative magnitudes of the first maximum height H1 and the fourth maximum height H4 depend on the total length of the optional boom 70 and the total length of the long arm 50L, the fourth maximum height H4 in the present embodiment is nearly equal to the first maximum height H1 (H4≈H1>H2).

Regarding the total weight of the work attachment AT, the total weight of the work attachment AT in the first use mode is greater than that in the second use mode because the first use mode includes the use of the first insert boom 30A that has a longer total length, when extended, than that of the second insert boom 30B and because the insert boom cylinder C30 for extending and bending the first insert boom 30A is mounted on the first insert boom 30A. For the same reasons, the total weight of the work attachment AT in the third use mode is greater than that in the fourth use mode.

The work attachment AT thus having the plurality of use modes is enabled to have a suitable shape and structure for the type and environment of work to perform the work excellently, by an appropriate selection of the selected insert boom from the first and second insert booms 30A and 30B (and further through a selection of presence/absence of addition of the optional boom 70 in the present embodiment).

Figure 6:
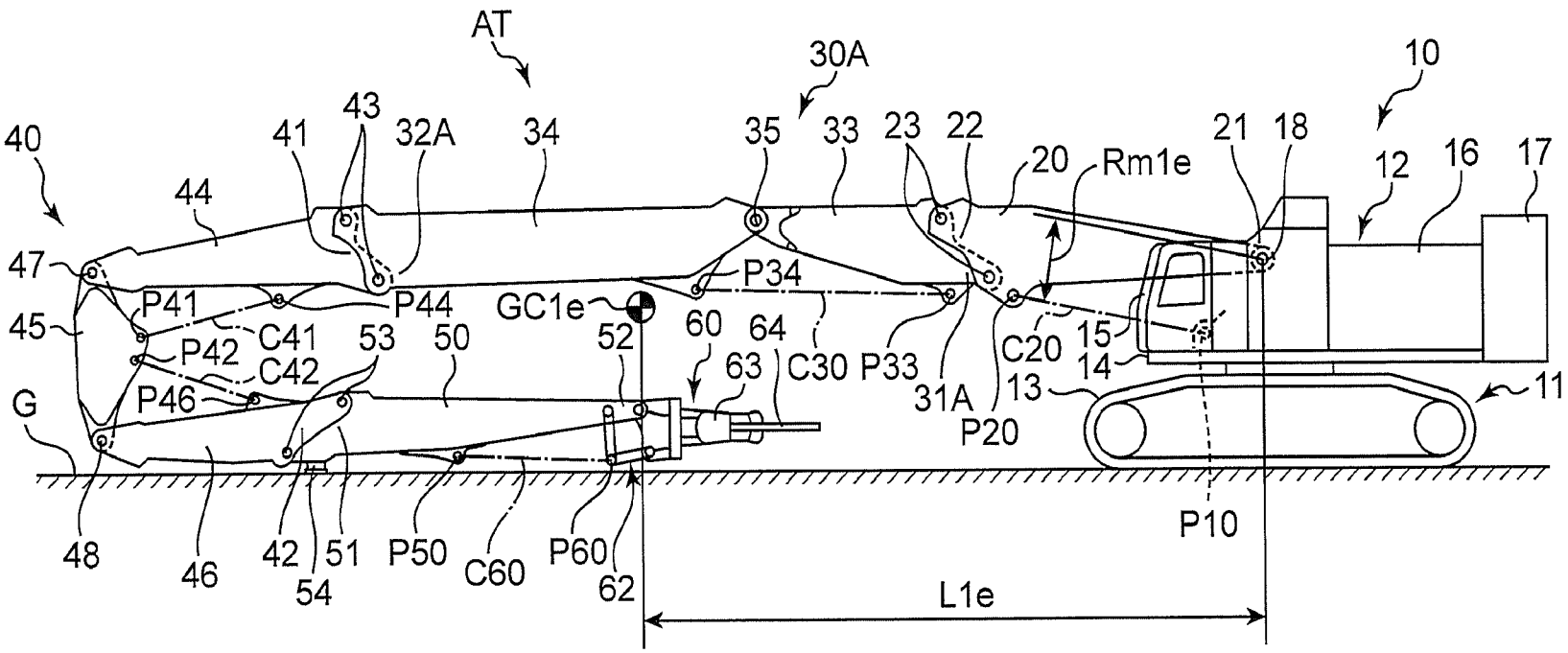
FIG. 6 is a side view of a state where the work attachment in the first use mode is in a fallen posture while the first insert boom is extended.

Specifically, selecting the second insert boom 30B, which is shorter than the first insert boom 30A in the extended state, from the first and second insert booms 30A, 30B as the selected insert boom to bring the work attachment AT into the second use mode as shown in FIGS. 4 and 5 enables the work by the distal working device 60 to be performed rapidly at a relatively low place with the reduced total weight of the work attachment AT. Moreover, in the second fallen posture including the second insert boom 30B, as shown in FIG. 4, the distance L2 from the boom foot pin 18 to the center of gravity of the work attachment AT (hereinafter, referred to as "attachment gravity center") GC2 can be restricted in comparison with the distance L1e from the boom foot pin 18 to an attachment gravity center GC1 e in an imaginary fallen posture where the first insert boom 30A is fallen while kept extending, for example as shown in FIG. 6, because the total length of the second insert boom 30B interposed between the main boom 20 and the intermediate boom 40 in the second use mode is less than the total length of the first insert boom 30A in the extended state. This allows the moment required to rotationally raise the entire work attachment AT and the driving force required to generate the moment to be restricted, in comparison with the imaginary posture.

On the other hand, selecting the first insert boom 30A as the selected insert boom to bring the work attachment AT into the first use mode as shown in FIGS. 1 to 3 enables the work by the distal working device 60 to be performed at a high place as shown in FIG. 3 with the first insert boom 30A being extended (in the extended state) at the middle joint. Moreover, in the first fallen posture including the first insert boom 30A, where the bend of the first insert boom 30A to project upward at the middle joint as shown in FIG. 1 allows the distance L1 from the boom foot pin 18 to the attachment gravity center GC1 to be less than the distance L1e in the imaginary fallen posture, the moment required to rotationally raise the entire work attachment AT held in the first fallen posture and the driving force required to generate the moment can be restricted in spite of the increased total weight of the entire work attachment AT due to the use of the first insert boom 30A.

In particular, in the present embodiment, the bend of the first insert boom 30A to allow the distal end of the distal working device 60 to reach the front end of the base machine 10 or the position backward thereof as shown in FIG. 1 enables the attachment gravity center GC1 in the first posture to be closer to the boom foot pin 18 than the attachment gravity center GC2 in the second fallen posture (L1<L2). This makes it possible to rotationally raise the work attachment AT held in the first fallen posture, in the case where a relatively heavy device is attached to the distal end of the arm 50 as the distal working device 60, with a smaller moment than that in the case where the work attachment AT is held in the second fallen posture.

Furthermore, in the present embodiment, selecting the third use mode (FIGS. 7 and 8), which is the use mode where the optional boom 70 is incorporated into the first use mode, enables the work by the distal working device 60 to be performed at a higher place than that in the case of the first use mode. Similarly, selecting the fourth use mode (FIGS. 9 and 10), which is the use mode where the optional boom 70 is incorporated into the second use mode, enables the work by the distal working device 60 to be performed at a higher place than that in the case of the second use mode. In the present embodiment, also in the third use mode additionally including the optional boom 70, the bent of the first insert boom 30A to allow the distal end of the distal working device 60 to reach the front end of the base machine 10 or the position backward thereof as shown in FIG. 7 enables the distance L3 from the boom foot pin 18 to an attachment gravity center GC3 in the third use mode to be less than the distance L4 from the boom foot pin 18 to the attachment gravity center GC4 in the fourth use mode and also less than the distance L2 in the second use mode. On the other hand, the distance from the boom foot pin 18 to the intermediate member 45 of the intermediate boom 40 in the third use mode is greater than that in the other use modes to thereby give an allowance to the arm length that allows the fallen posture to be taken, which enables a further longer arm than the long arm L50 shown in FIG. 9 to be used to further increase the maximum working height.

In the present embodiment, although the first maximum height H1 (FIG. 3) achieved in the first use mode and the fourth maximum height H4 (FIG. 10) achieved in the fourth use mode are nearly equal to each other, it is also possible to restrict the distance L1 from the boom foot pin 18 to the attachment gravity center GC1 in the first use mode under the distance L4 from the boom foot pin 18 to the attachment gravity center GC4 in the fourth use mode. In view of this point, it is possible to appropriately select one of the first and fourth use modes based on the work conditions other than the required maximum height. For example, for the case where the distal working device 60 is so heavy as to generate necessity of giving priority to reducing the moment required to rotationally raise the work attachment AT from the fallen posture, it is preferable to select the first use mode that allows the distance L1 from the boom foot pin 18 to the attachment gravity center GC1 in the fallen posture to be less than that in the fourth use mode. In contrast, for the case where the distal working device 60 is so light that a greater importance is placed on the rapidity of work than the restriction of the required moment in the raising direction from the fallen posture or for the case where the hardness of the ground surface G is relatively low and this involves a limit on the ground contact pressure of the base machine 10 (that is, there is a limit on the total weight of the work machine), it is preferable to select the fourth use mode that allows the work attachment AT to have a smaller total weight than that in the first use mode.

In the above-described embodiment, the main boom cylinder C20 for raising and lowering the main boom 20 has the machine-side end connected to the base machine 10 so as to be capable of rotational movement and the boom-side end connected to the main boom 20 so as to be capable of rotational movement, being disposed so as to have a rising angle to the horizontal plane which is increased with increase in the rising angle of the main boom 20 to the horizontal plane, thereby allowing the rising angle of the main boom cylinder C20 in the first fallen posture, where the first insert boom 30A is bent to project upward, to be greater than that in the second fallen posture. This enables the radius of the moment generated by the thrust of the main boom cylinder C20 about the boom foot pin 18 in the first fallen posture (a radius Rm1 shown in FIG. 1 in the first use mode and a radius Rm3 shown in FIG. 7 in the third use mode) to be greater than the radius of moment in the second fallen posture (a radius Rm2 shown in FIG. 4 in the case of the second use mode and a radius Rm4 shown in FIG. 10 in the case of the fourth use mode) to thereby allow the thrust of the main boom cylinder 20 required to rotationally raise the work attachment AT to be further restricted.

As described above, a work attachment is provided, constituting a work machine and being capable of taking a fallen posture in a folded state and capable of performing work at a high place without significantly increasing the driving force required for the rotational movement in the rising direction from its fallen posture, and a work machine including the work attachment is provided.

Provided is a work attachment to be attached to a base machine of a work machine so as to be raiseable and lowerable, being capable of taking a fallen posture in which the work attachment is fallen down on a ground surface forward of the base machine, the work attachment comprising: a main boom having a proximal end to be connected to the base machine so as to be capable of rotational movement about a predetermined boom rotation center axis to be raised and lowered and a distal end opposite to the proximal end; a first insert boom having a proximal end connectable to the distal end of the main boom detachably and a distal end opposite to the proximal end of the first insert boom; a second insert boom having a proximal end connectable to the distal end of the main boom detachably and a distal end opposite to the proximal end of the second insert boom; an intermediate boom having a proximal end connectable detachably to either of the distal end of the first insert boom and the distal end of the second insert boom and a distal end opposite to the proximal end of the intermediate boom; an arm having a proximal end connected to the distal end of the intermediate boom so as to be capable of rotational movement relative to the intermediate boom about an axis parallel to the boom rotation center axis and a distal end opposite to the proximal end of the arm; and a distal working device connected to the distal end of the arm and configured to perform a specific working motion. Each of the first insert boom and the second insert boom is capable of being selectively interposed between the distal end of the main boom and the proximal end of the intermediate boom to be used as a selected insert boom. The intermediate boom has a first joint and a second joint located closer to the distal end thereof than the first joint, being bendable about an axis parallel to the boom rotation center axis so as to project outward at each of the first joint and the second joint. The second insert boom has a fixed shape extending in a specific direction of interconnecting the distal end of the main boom and the proximal end of the intermediate boom, and has a length that allows the entire work attachment to take a second fallen posture when being selected as the selected insert boom. The second fallen posture is a posture satisfying the following conditions: the main boom and the second insert boom extend horizontally; the intermediate boom is bent to project outward at each of the first joint and the second joint at a foremost position of the work attachment to thereby direct both the proximal end and the distal end of the intermediate boom backward; and the arm extends horizontally under the main boom and the second insert boom while touching the ground surface. The first insert boom has a middle joint located between the proximal end and the distal end thereof, being bendable about an axis parallel to the boom rotation center axis so as to project outward at the middle joint. The working attachment with the first insert boom selected as the selected insert boom has a total weight greater than a total weight of the working attachment with the second insert boom selected as the selected insert boom. The first insert boom has a greater total length with the middle joint extended linearly than a total length of the second insert boom, and has a shape to allow the entire work attachment to take a first fallen posture when the first insert boom is bent to project outward at the middle joint. The first fallen posture is a posture satisfying the following conditions: the main boom is inclined upward from the proximal end toward the distal end thereof; the first insert boom is bent to project upward at the middle joint so that a proximal portion of the first insert boom is inclined upward from the proximal end toward the middle joint and a distal portion of the first insert boom is inclined downward from the middle joint toward the proximal end of the intermediate boom, the proximal portion being a portion located on a proximal-end side of the middle joint, the distal portion being a portion located on a distal-end side of the middle joint; the intermediate boom is bent so as to project outward at each of the first joint and the second joint at the foremost position of the work attachment to direct both the proximal end and the distal end of the intermediate boom backward; and the arm extends horizontally under the main boom and the first insert boom while touching the ground surface, the bend of the first insert boom at the middle joint shifting a position of the distal working device horizontally toward the boom rotation center axis by a distance corresponding to the bend.

According to this work attachment, selecting appropriate one from the first insert boom and the second insert boom as the selected insert boom and interposing it between the main boom and the intermediate boom enables the work attachment to have a shape and structure suitable for the type and environment of work. Specifically, selecting the second insert boom as the selected insert boom from the first and second insert booms enables the work by the distal working device to be performed rapidly at relatively low heights with the restricted total weight of the work attachment. Besides, regarding the second fallen posture where the total length of the second insert boom interposed between the main boom and the intermediate boom is less than the total length of the extended first insert boom, the moment required to rotationally raise the entire work attachment while keeping the work attachment in the second fallen posture and the driving force required to generate the moment can be restricted. On the other hand, selecting the first insert boom as the selected insert boom enables the work by the distal working device to be performed at a high place with the first insert boom extended at the middle joint. Furthermore, in the first fallen posture where the first insert boom is bent to project at the middle joint to shift the center of gravity of the entire work attachment toward the boom rotation center axis by a distance corresponding to the bend, the moment required to rotationally raise the entire work attachment kept in the first fallen posture and the driving force required to generate the moment can be restricted in spite of the increase in the total weight of the entire work attachment due to the use of the first insert boom.

It is preferable that the work attachment further comprises an insert boom cylinder attached to the first insert boom for extending and bending the first insert boom and having opposite ends connected to a portion located on a proximal-end side of the middle joint in the first boom and a portion located on a distal-end side of the middle joint in the first insert boom, the insert boom cylinder being configured to change a bending angle of the first insert boom by expansion and contraction of the insert boom cylinder. This allows the first insert boom and the second insert boom to be replaced with each other while the opposite ends of the insert boom cylinder is kept connected to the first insert boom. Thus, differently from a mode where one end of the insert boom cylinder is connected to a component other than the first insert boom (e.g. the main boom or the intermediate boom), the necessity is eliminated of attaching or detaching the insert boom cylinder to or from the other component at the time of attaching or detaching the first insert boom to or from the main boom and the intermediate boom.

The respective proximal ends of the first and second insert booms are not limited to ones connected directly to the distal end of the main boom but are also allowed to be connected to the main boom via another component. Specifically, it is preferable that the work attachment further comprises an optional boom capable of being additionally interposed between the distal end of the main boom and the selected insert boom, the optional boom having a proximal end connectable to the distal end of the main boom detachably and a distal end connectable detachably to either of the proximal end of the first insert boom and the proximal end of the second insert boom.

In either case of use of the first insert boom or use of the second insert boom as the selected insert boom, the optional boom can be interposed between the proximal end of the selected insert boom and the distal end of the main boom to thereby enables the distal working device to have further increased maximum working height.

According to the present invention, also provided is a work machine comprising: a base machine capable of travelling on a ground surface; and the above-described work attachment, wherein the proximal end of the main boom of the work attachment is connected to the base machine so as to be capable of rotational movement about a predetermined boom rotation center axis to allow the main boom to be raised and lowered.

In the above-described work machine, it is preferable that the work attachment further comprises a main boom cylinder expandable and contractable to raise and lower the main boom relatively to the base machine, the main boom cylinder having a machine-side end connected to the base machine so as to be capable of rotational movement about an axis parallel to the boom rotation center axis and a boom-side end connected to the main boom so as to be capable of rotational movement about an axis parallel to the boom rotation center axis, wherein the main boom cylinder is disposed so as to raise and lower the main boom cylinder relatively to the base machine by expansion and contraction of the main boom cylinder and so as to have a rising angle to a horizontal plane, the rising angle increasing with increase in a rising angle of the main boom to the horizontal plane. The rising angle of the main boom in the first fallen posture is increased by the bend of the first insert boom to project upward at the middle joint and the rising angle of the main boom cylinder is also increased involved thereby, which increases the upward direction component of the thrust of the main boom cylinder. This increases the raising moment (i.e. the moment for rotationally raising the main boom) generated by the thrust of the main boom cylinder, in other words, enables the work attachment in the first fallen posture to be raised with a smaller thrust of the main boom cylinder.

In the above-described work machine, it is preferable that the first insert boom is capable of being bent at the middle joint enough to allow the arm of the work attachment in the first fallen posture to be laid on the ground surface at a position where the distal end of the distal working device reaches a front end of the base machine. This allows the moment required to rotationally raise the entire work attachment in the first fallen posture to be reduced.

Furthermore, in the work machine in which the work attachment includes the optional boom, it is preferable that the first insert boom is configured to be capable of being bent at the middle joint enough to allow the arm of the work attachment, also in the first fallen posture including the optional boom interposed between the first insert boom and the main boom, to be laid on the ground surface at a position where the distal end of the distal working device reaches the front end of the base machine.

This application is based on Japanese Patent application No. 2019-137726 filed in Japan Patent Office on Jul. 26, 2019, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A work attachment to be attached to a base machine of a work machine so as to be raiseable and lowerable, being capable of taking a fallen posture in which the work attachment is fallen down on a ground surface forward of the base machine, the work attachment comprising:

a main boom having a proximal end to be connected to the base machine so as to be capable of rotational movement about a predetermined boom rotation center axis to be raised and lowered and a distal end opposite to the proximal end;

a first insert boom having a proximal end connectable to the distal end of the main boom detachably and a distal end opposite to the proximal end of the first insert boom;

a second insert boom having a proximal end connectable to the distal end of the main boom detachably and a distal end opposite to the proximal end of the second insert boom;

an intermediate boom having a proximal end connectable detachably to either of the distal end of the first insert boom and the distal end of the second insert boom and a distal end opposite to the proximal end of the intermediate boom;

an arm having a proximal end connected to the distal end of the intermediate boom so as to be capable of rotational movement relative to the intermediate boom about an axis parallel to the boom rotation center axis and a distal end opposite to the proximal end of the arm; and a distal working device connected to the distal end of the arm and configured to perform a specific working motion, wherein:

each of the first insert boom and the second insert boom is capable of being selectively interposed between the distal end of the main boom and the proximal end of the intermediate boom to be used as a selected insert boom;

the intermediate boom has a first joint and a second joint located closer to the distal end thereof than the first joint, the intermediate boom configured to be bendable about an axis parallel to the boom rotation center axis so as to project outward at each of the first joint and the second joint;

the second insert boom has a fixed shape extending in a specific direction of interconnecting the distal end of the main boom and the proximal end of the intermediate boom, and has a length that allows the entire work attachment to take a second fallen posture when being selected as the selected insert boom, the second fallen posture being a posture satisfying the following conditions: the main boom and the second insert boom extend horizontally; the intermediate boom is bent to project outward at each of the first joint and the second joint at a foremost position of the work attachment to thereby direct both the proximal end and the distal end of the intermediate boom backward; and the arm extends horizontally under the main boom and the second insert boom while touching the ground surface;

the first insert boom has a middle joint located between the proximal end and the distal end of the first insert boom, being bendable about an axis parallel to the boom rotation center axis so as to project outward at the middle joint, the working attachment that includes the first insert boom selected as the selected insert boom having a total weight greater than a total weight of the working attachment that includes the second insert boom selected as the selected insert boom; and the first insert boom has a greater total length with the middle joint extended linearly than a total length of the second insert boom, and has a shape to allow the entire work attachment to take a first fallen posture when the first insert boom is bent to project outward at the middle joint, the first fallen posture being a posture satisfying the following conditions: the main boom is inclined upward from the proximal end toward the distal end thereof; the first insert boom is bent to project upward at the middle joint so that a proximal portion of the first insert boom is inclined upward from the proximal end toward the middle joint and a distal portion of the first insert boom is inclined downward from the middle joint toward the proximal end of the intermediate boom, the proximal portion being a portion located on a proximal-end side of the middle joint, the distal portion being a portion located on a distal-end side of the middle joint; the intermediate boom is bent so as to project outward at each of the first joint and the second joint at the foremost position of the work attachment to direct both the proximal end and the distal end of the intermediate boom backward; and the arm extends horizontally under the main boom and the first insert boom while touching the ground surface, the bend of the first insert boom at the middle joint shifting a position of the distal working device horizontally toward the boom rotation center axis by a distance corresponding to the bend.

2. The work attachment according to claim 1, further comprising:

an insert boom cylinder attached to the first insert boom to extend and bend the first insert boom and having opposite ends connected to a portion located on a proximal-end side of the middle joint in the first boom and a portion located on a distal-end side of the middle joint in the first insert boom, the insert boom cylinder being configured to change a bending angle of the first insert boom by expansion and contraction of the insert boom cylinder.

3. The work attachment according to claim 1, further comprising:

an optional boom capable of being additionally interposed between the distal end of the main boom and the selected insert boom, the optional boom having a proximal end connectable to the distal end of the main boom detachably and a distal end connectable detachably to either of the proximal end of the first insert boom and the proximal end of the second insert boom.

4. A work machine, comprising:

a base machine capable of travelling on a ground surface; and the work attachment according to claim 1, wherein the proximal end of the main boom of the work attachment is connected to the base machine so as to be capable of rotational movement about a predetermined boom rotation center axis to allow the main boom to be raised and lowered.

5. The work machine according to claim 4, wherein the first insert boom is configured to be bendable at the middle joint enough to allow the arm of the work attachment in the first fallen posture to be laid on the ground surface at a position where the distal end of the distal working device reaches a front end of the base machine.

6. The work machine according to claim 5, wherein the work attachment further comprises an optional boom capable of being additionally interposed between the distal end of the main boom and the selected insert boom, the optional boom having a proximal end connectable to the distal end of the main boom detachably and a distal end connectable detachably to either of the proximal end of the first insert boom and the proximal end of the second insert boom, the first insert boom being configured to be capable of being bent at the middle joint enough to allow the arm of the work attachment, in the first fallen posture including the optional boom interposed between the first insert boom and the main boom, to be laid on the ground surface at a position where the distal end of the distal working device reaches the front end of the base machine.

7. The work machine according to claim 4, wherein the work attachment further comprises a main boom cylinder expandable and contractable to raise and lower the main boom relatively to the base machine, the main boom cylinder having a machine-side end connected to the base machine so as to be capable of rotational movement about an axis parallel to the boom rotation center axis and a boom-side end connected to the main boom so as to be capable of rotational movement about an axis parallel to the boom rotation center axis, wherein the main boom cylinder is disposed so as to raise and lower the main boom cylinder relatively to the base machine by expansion and contraction of the main boom cylinder and so as to have a rising angle to a horizontal plane, the rising angle increasing with increase in a rising angle of the main boom to the horizontal plane.

8. The work machine according to claim 4, wherein the work attachment further includes: an insert boom cylinder attached to the first insert boom to extend and bend the first insert boom and having opposite ends connected to a portion located on a proximal-end side of the middle joint in the first boom and a portion located on a distal-end side of the middle joint in the first insert boom, the insert boom cylinder being configured to change a bending angle of the first insert boom by expansion and contraction of the insert boom cylinder.

* * * * *